US005288150A

United States Patent [19]

Bearman

[11] Patent Number: 5,288,150

[45] Date of Patent: Feb. 22, 1994

[54] TOTE-BAG WITH SECONDARY ACCESS OPENING FOR REMOVING DEBRIS

[76] Inventor: Jodi Bearman, 10217 Hunt Club La., Palm Beach Gardens, Fla. 33418

[21] Appl. No.: 2,911

[22] Filed: Jan. 11, 1993

[51] Int. Cl.[5] ..... B65D 30/06; B65D 30/22

[52] U.S. Cl. ..... 383/38; 383/67; 383/75; 383/117; 150/112

[58] Field of Search ..... 383/18, 38, 41.67, 75, 383/76, 97, 100, 101, 102, 110, 117; 190/109, 111; 150/112, 117

[56] References Cited

U.S. PATENT DOCUMENTS

| | | | |
|---|---|---|---|
| 1,206,195 | 11/1916 | Beline | 383/117 X |
| 1,251,404 | 12/1917 | Mills | 383/67 X |
| 1,581,985 | 4/1926 | Sachs | 383/38 X |
| 3,052,895 | 9/1962 | Lo Vico . | |
| 3,202,191 | 8/1965 | Kaplan | 150/117 |
| 3,749,211 | 7/1973 | Cima | 383/117 X |
| 4,078,595 | 3/1978 | Mittlemann | 150/112 |
| 4,156,446 | 5/1979 | Nathan | 383/76 X |
| 4,180,112 | 12/1979 | Bovet . | |
| 4,188,988 | 2/1980 | Agyagos . | |
| 4,480,766 | 11/1984 | Platt . | |
| 4,503,559 | 3/1985 | Warnke | 383/117 X |
| 4,753,329 | 6/1988 | Choy . | |
| 4,967,986 | 11/1990 | Schildkraut . | |
| 4,979,833 | 12/1990 | Cook . | |
| 5,154,266 | 10/1992 | Bieber et al. . | |

*Primary Examiner*—Allan N. Shoap
*Assistant Examiner*—Jes F. Pascua
*Attorney, Agent, or Firm*—Quarles & Brady

[57] ABSTRACT

A tote-bag having a mesh inner lining with a primary opening for depositing articles therein and an outer lining attached to the inner lining, the outer lining having a primary opening and a secondary opening. The secondary opening includes closure means such as a zipper, which can seal said secondary opening to prevent sand and debris deposited therein from exiting the tote-bag. Carrying handles may be provided for conveniently grasping the tote-bag.

14 Claims, 5 Drawing Sheets

TOTE-BAG WITH SECONDARY ACCESS OPENING FOR REMOVING DEBRIS

BACKGROUND OF THE INVENTION

Ordinary tote-bags suffer from a common problem when they are used to carry articles to and from sandy areas, such as a beach. In particular, when articles such as blankets, children's toys, clothing, or other items are used in sandy areas, they will generally tend to accumulate on their surface and in crevices, particles of sand and other debris. When these articles are stored away in ordinary tote-bags for transport home, the sand that has accumulated on the various articles will have a tendency to collect inside the tote-bag. For example, as damp articles dry, the sand accumulated thereon will have a tendency to drop off and collect at the bottom of the tote-bag.

Upon arriving at one's destination and unloading the content of the ordinary tote-bag, the sand that is accumulated therein will have the undesirable tendency to spill out of the bag, requiring time-consuming cleaning. With ordinary tote-bags, it is quite difficult to remove the sand from the inside of the tote-bag until all of the articles contained therein have been removed. Thus, in order to avoid spilling sand from the interior of the tote-bag, the user must remove the articles from the tote-bag outdoors, invert the bag to remove the sand, and then return the articles to the bag once this procedure has been completed. Significantly, however, even when this procedure is followed, sand may still be retained within a tote-bag and unintentionally brought indoors. For example, ordinary tote-bags often have many seams and compartments which trap sand and cause difficulty in removing it from the interior of the tote-bag. As a result, sand will remain in the tote-bag and will occasionally spill out when the tote-bag is transported or unpacked.

The prior art in tote-bags has included designs which partly alleviate the problem described above. See, for example, U.S. Pat. No. 4,979,833 to Cook. Cook discloses a plastic mesh bag which can be used as a beach bag. Among other things, the tote-bag disclosed in Cook would permit sand which has accumulated on articles to simply sift out of the bag as it is being carried. While solving the problem of sand accumulating in the tote-bag, Cook creates an additional problem in that sand which exits the bag through the mesh material from which it is made, will be deposited wherever the bag is carried or placed. Thus, if the bag is placed, for example, in an automobile, sand which drops from articles contained within the tote-bag of Cook will be deposited on the floor or trunk of the vehicle.

The present invention is designed to alleviate the problems found in tote-bags of the prior art, and provides a tote-bag capable of conveniently carrying various articles to and from a beach.

SUMMARY OF THE INVENTION

The present invention relates to a tote-bag particularly adapted for use in carrying articles to and from sandy areas. The bag includes an inner lining or compartment of mesh material which compartment is accessible through a primary opening for use in placing or removing articles. An outer lining, also having a primary opening, surrounds and is attached to the inner lining to contain sand or other debris which may drop from articles placed within the inner lining. The outer lining also features a secondary access opening by which sand or other debris accumulating therein can be conveniently removed.

DESCRIPTION OF THE DRAWINGS

There are shown in the drawings, embodiments which are presently preferred. It is understood, however, that the invention is not limited to the present arrangement and instrumentalities shown, wherein.

DETAILED DESCRIPTION OF THE INVENTION

Figure 1:
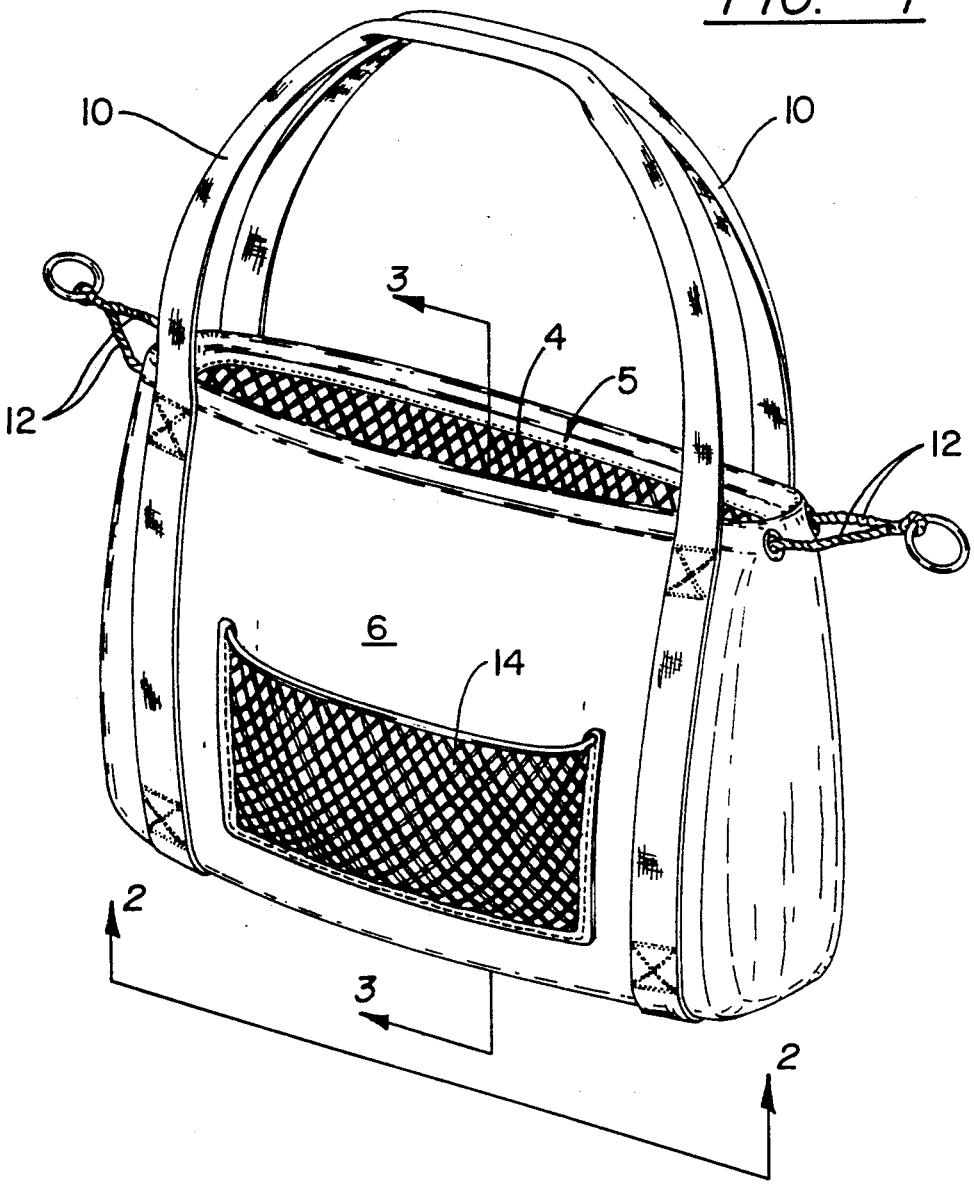
FIG. 1 is a perspective view of a tote-bag according to the present invention.
Figure 2:
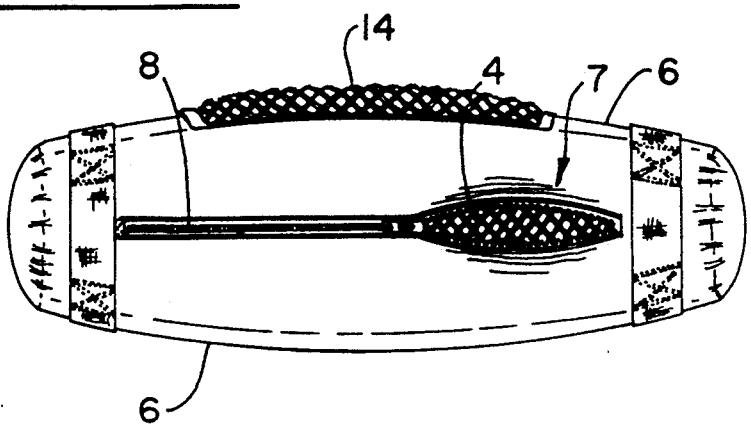
FIG. 2 is a bottom view of the tote-bag shown with its secondary access opening in a partially open position.
Figure 3:
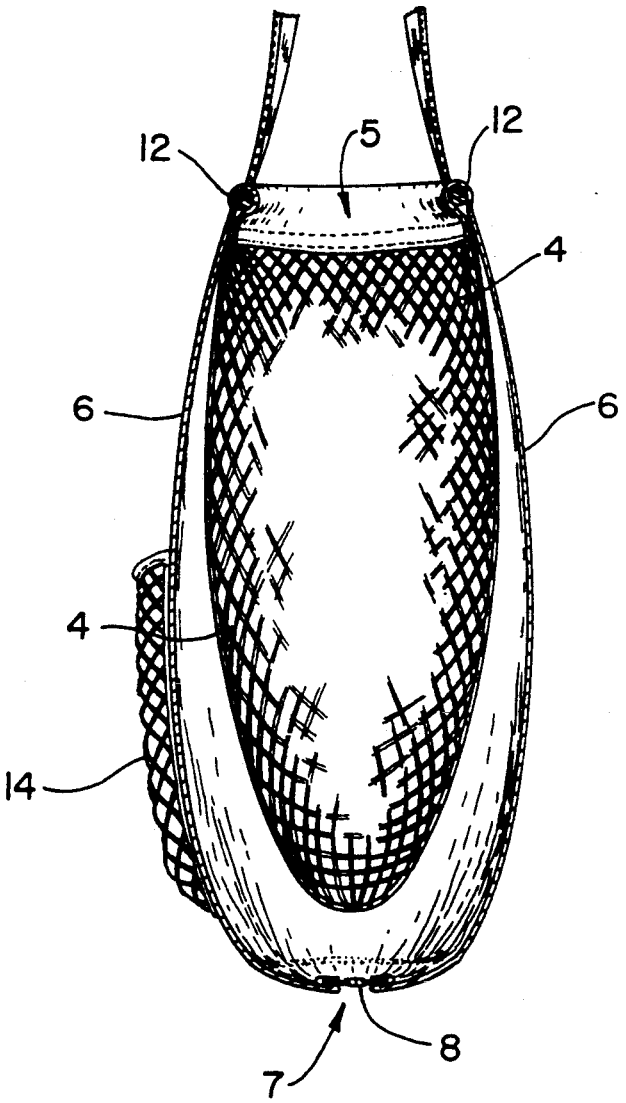
FIG. 3 is a cross-sectional view of the tote-bag taken along line 3—3 in FIG. 1.

A tote-bag constructed in accordance with the present invention is shown in FIGS. 1–3. The tote-bag includes an inner lining 4 of mesh-like material, which is accessible through a primary opening 5 for use in placing or removing articles in the bag. The mesh-like material may be nylon netting or any other suitable material of sufficient porosity to allow particles of sand to easily pass through the material. An outer lining 6 having a common primary opening 5 with the inner lining 4 is preferably fastened to said inner lining 4 at the periphery of the primary opening 5.

Outer lining 6 is provided with a secondary opening 7 and secondary opening closure means 8. In a preferred embodiment, secondary opening 7 is located at a lower portion of the tote-bag for convenient removal of debris which accumulates within the outer lining 6 of the bag. However, secondary opening 8 may be located on any convenient portion of the tote-bag to permit sand and other debris accumulating therein to be removed. Secondary opening closure means 8 is preferably a zipper capable of sealing the outer lining 6 to prevent sand contained therein from escaping until the closure means is opened. However, any suitable closure means capable of containing sand within the outer lining can also be used for this purpose.

Closure means, such as drawstring 12 can be provided at the periphery of primary opening 5 to prevent articles contained within the tote-bag from unintentionally being dislodged. However, the invention is not so limited. Any suitable closure means such as snaps, buttons, zippers, straps or velcro can be used to close off the primary opening as needed. Alternatively, the invention will also function without any closure means associated with primary opening 5.

Carrying means such as strap handles 10 can be provided to permit the tote-bag to be conveniently carried by a user. The strap means are not necessary, however, and the invention will function without them. If strap handles 10 are used as carrying means, they are preferably formed from a continuous piece of flexible reinforced material attached to the outer lining in an area substantially near the outer edges of the tote-bag as shown in FIG. 1. When formed in this manner, the strap handle 10 provides support means which extend beneath the tote-bag for carrying heavy articles. Strap handles 10 are preferably located toward the outer edges of the tote-bag so that they do not interfere with the opening and closing of the secondary opening 8 of the outer lining 6.

In a preferred embodiment of the present invention, the outer lining is formed from waterproof material to prevent damp articles contained therein from depositing water in vehicles or homes.

Figure 4:
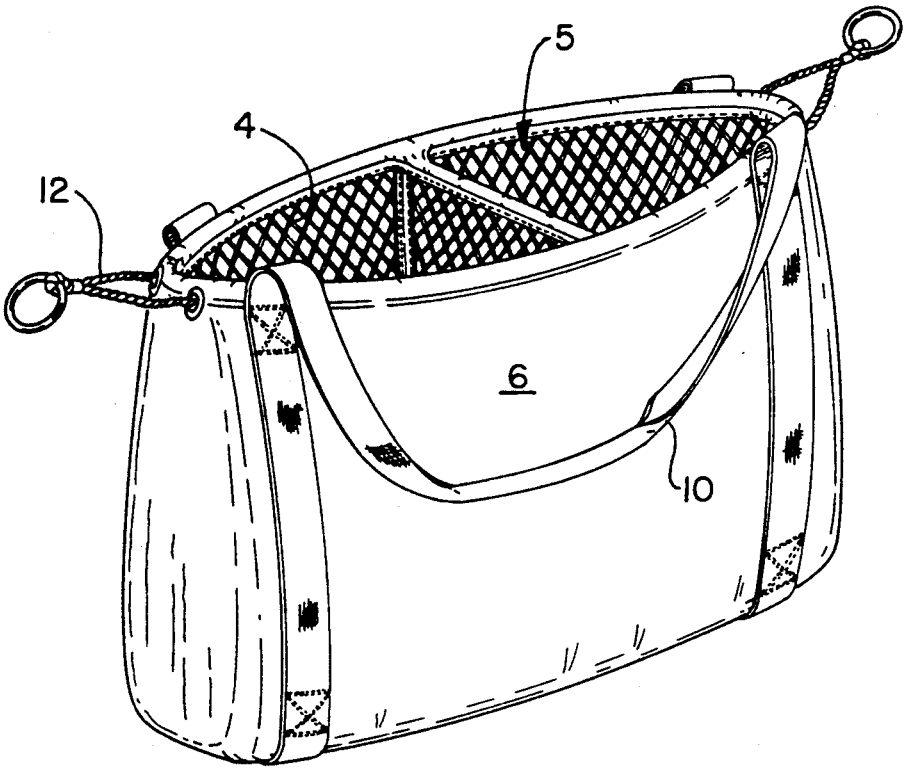
FIG. 4 is a perspective view of a tote-bag according to the present invention, which is laterally separated into two separate compartments by a mesh separating material.
Figure 5:
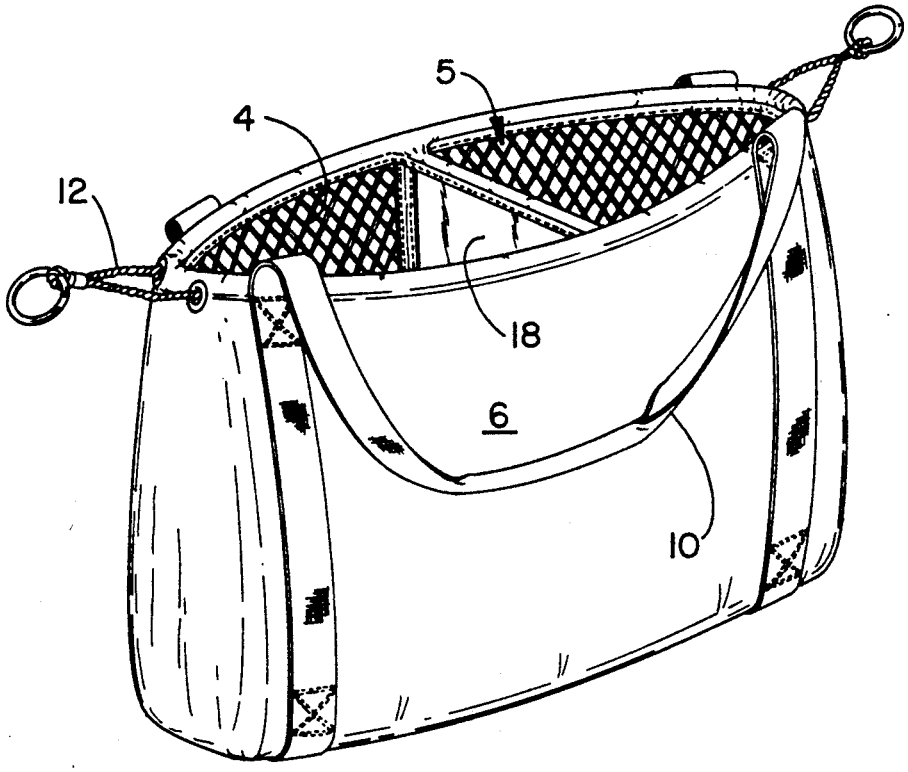
FIG. 5 is a perspective view of a tote-bag according to the present invention, wherein the inner lining is separated into two separate compartments by means of waterproof material.
Figure 6:
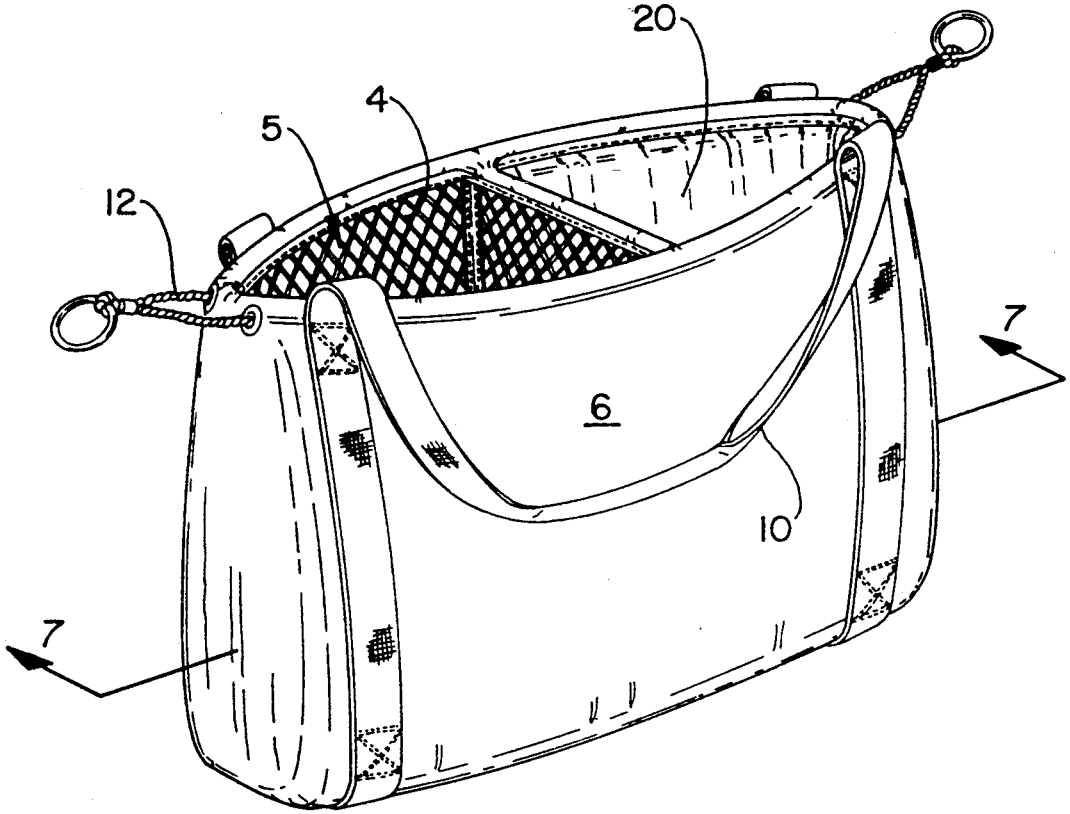
FIG. 6 is a perspective view of a tote-bag according to the present invention, wherein a separate compartment is formed from an insulating material.
Figure 7:
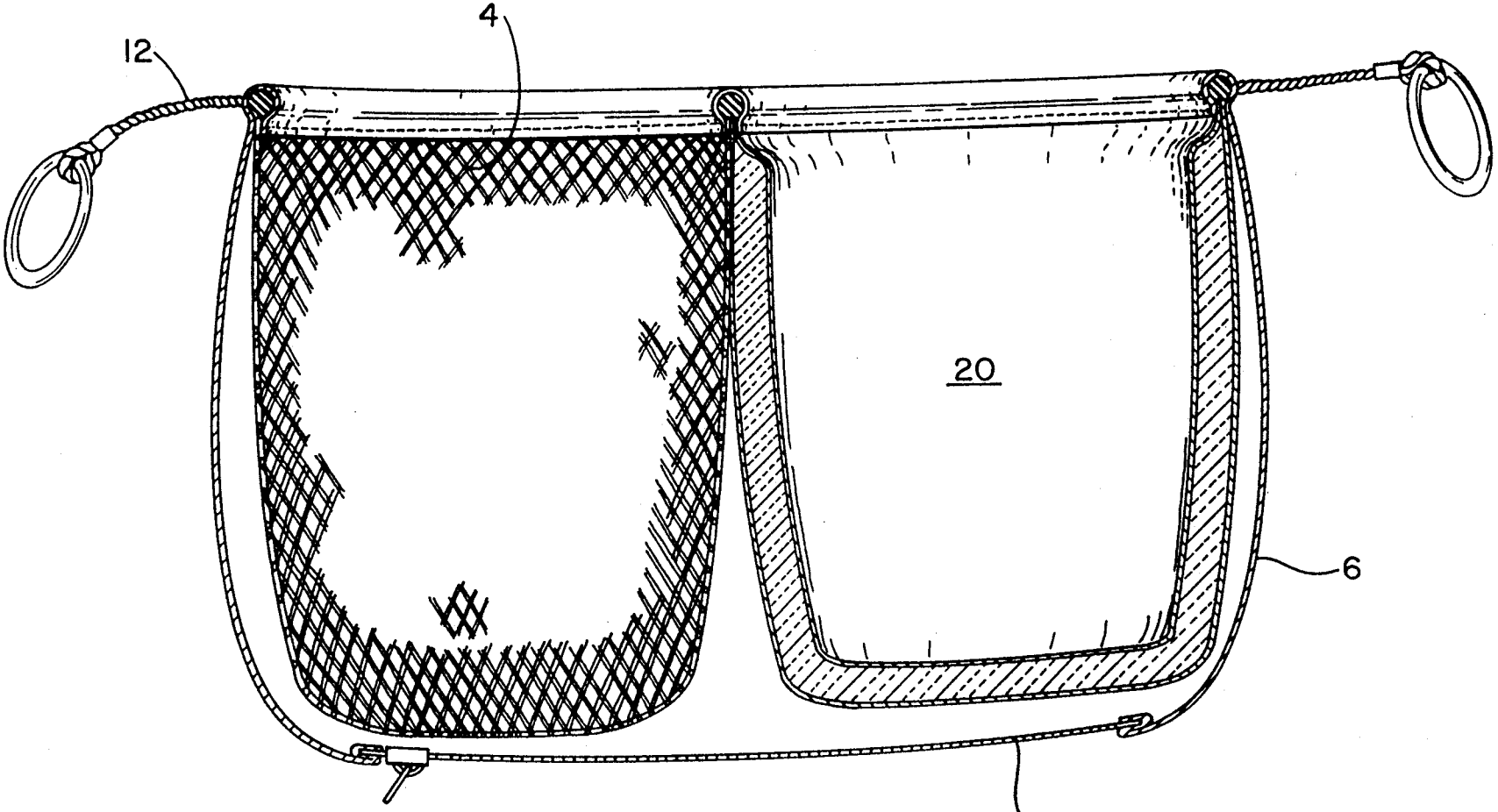
FIG. 7 is a cross-sectional view of the tote-bag taken along line 7—7 in FIG. 6.

The tote-bag shown in FIGS. 1–3 has a single compartment formed by inner lining 4. However, the invention is not so limited. As shown in FIGS. 4–7, various alternative embodiments are possible, so long as loose sand and debris dropping from articles placed in the bag are still able to pass through mesh inner lining 4. Thus, for example, the bag could be separated longitudinally or laterally by flexible material to create separate compartments therein. In FIG. 4, the bag is laterally separated by mesh material 16 attached to inner lining 4. Significantly, however, any other suitable material may also be used for this purpose. For example, as shown in FIG. 5, the separating material may be formed from waterproof material 18 to prevent damp articles deposited within the bag from causing all of the other articles deposited therein from also becoming damp. Alternatively, as shown in FIGS. 6 and 7, one or more compartments within the tote-bag may be formed from an insulating material 20 capable of keeping articles stored therein hot or cold as may be necessary.

In a further alternative embodiment, an additional compartment 14 may be attached to the exterior of the tote-bag. The exterior compartment 14 may be formed of mesh-like material or some other suitable material capable of containing articles.

The tote-bag of the present invention is especially advantageous for use in carrying articles to and from sandy beach areas. According to the present invention, when articles used at a beach are to be transported home, they are placed within the inner lining 4 of the tote-bag. The secondary opening 7 of the outer lining can be maintained in a closed position when sandy articles are transported within the tote-bag. As the articles are being transported, sand and other debris which has collected on the articles will have a tendency to dry and drop from such articles. In the present invention, this loose sand and other debris passes through openings in the mesh inner lining 4 and is trapped in outer lining 6. The outer lining 6 contains the sand and prevents it from being prematurely released from the bag. Upon arriving at one's destination, either before or after such sandy articles have been removed from the tote-bag, secondary opening closure means 8 can be opened to permit sand which has collected within the outer lining 6 to be disposed of, preferably in an outdoor area. After loose sand has been released, the secondary opening 7 can be closed and the tote-bag can be brought indoors.

The tote-bag of the present invention offer significant advantages over those of the prior art as it permits loose sand collected within the bag to be disposed of without the need to first remove the articles contained therein.

It will be appreciated that numerous embodiments and modifications of the above tote-bag may be devised by those skilled in the art, and it is intended that the appended claims cover all such modifications and embodiments as fall within the true spirit and scope of the present invention.

I claim:

1. A tote-bag comprising:

an outer lining formed from a flexible, water resistant material capable of containing particulate matter;

an inner lining having at least one compartment formed of mesh-like material completely disposed within and surrounded by said outer lining;

said outer lining having at least a first and second opening, said first opening providing access into said inner lining, said second opening traversing substantially a bottom portion of said outer lining to facilitate removal of particulate matter, said second opening accessing only into said outer lining; and closure means for closing said second opening.

2. The tote-bag of claim 1, wherein said inner lining is separated into a plurality of separate inner lining compartments by at least one separating wall formed of a flexible material.

3. The tote-bag of claim 2, wherein at least one of said plurality of separate inner lining compartments is separated from the remainder of said separate inner lining compartments by means of a waterproof lining.

4. The tote-bag of claim 2, wherein at least one of said plurality of separate inner lining compartments is formed from insulating material to form an insulated compartment.

5. The tote-bag of claim 1, wherein said first opening is provided with closure means for closing said first opening.

6. The tote-bag of claim 5, wherein said closure means is a drawstring attached to a peripheral portion of said tote-bag adjacent to said first opening.

7. The tote-bag of claim 1, wherein said second opening is located at a bottom portion of said outer lining opposite from said first opening.

8. The tote-bag of claim 1, wherein said second opening closure means includes a zipper.

9. The tote-bag of claim 1, wherein said tote-bag includes carrying means for grasping the tote-bag.

10. The tote-bag of claim 9, wherein said carrying means is a strap handle formed from a continuous length of reinforced flexible material attached to said outer lining, said strap handle positioned parallel and adjacent to opposing end portions of said outer lining so as not to interfere with access to the interior of said outer lining through the second opening.

11. The tote-bag of claim 1, wherein said inner lining is attached to said outer lining along a peripheral portion of said outer lining adjacent to said first opening.

12. The tote-bag of claim 1, wherein a separate compartment formed of mesh-like material is attached to the exterior of the outer lining.

13. A tote-bag comprising:

an inner lining formed of mesh-like material, said inner lining having a first primary opening for depositing articles therein;

an outer lining formed from a flexible, water resistant material capable of containing particulate matter fastened to, completely enclosing and surrounding said inner lining, said outer lining having a second primary opening for allowing articles to be deposited in said inner lining, said outer lining having a secondary opening traversing substantially a bottom portion of said tote-bag to facilitate removal of particulate matter, said secondary opening having closure means for closing said secondary opening for preventing debris contained within said outer lining from inadvertently escaping.

14. A tote-bag comprising:

an outer member formed of a flexible material capable of containing particulate matter, said outer member having a first opening and a first closure means for closing said first opening;

an inner lining separated into a plurality of separate inner lining compartments by at least one separating wall formed of a flexible material; at least one of said plurality of inner lining compartments substantially entirely formed of mesh-like material, said inner lining joining said outer member around the periphery of said first opening;

a second opening into said outer member traversing substantially a bottom portion of said outer member to facilitate removal of particulate matter from an interior portion of said outer member, and second closure means for closing said second opening; and a carrying means for grasping the tote-bag, said carrying means being a strap handle formed from a continuous length of flexible material attached to said outer lining, said strap handle positioned parallel and adjacent to opposing end portions of said outer member to avoid interfering with access to the interior portion of said outer member through the second opening.

* * * * *